US008678517B2

(12) United States Patent
Monyak et al.

(10) Patent No.: US 8,678,517 B2
(45) Date of Patent: Mar. 25, 2014

(54) REDUCED VOLUME CUTTING TIP AND CUTTING BIT INCORPORATING SAME

(75) Inventors: Kenneth Monyak, Abingdon, VA (US); Daniel Mouthaan, Williamsburg, MI (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 302 days.

(21) Appl. No.: 12/908,193

(22) Filed: Oct. 20, 2010

(65) Prior Publication Data

US 2012/0098326 A1 Apr. 26, 2012
US 2013/0140873 A9 Jun. 6, 2013

Related U.S. Application Data

(63) Continuation-in-part of application No. 12/192,195, filed on Aug. 15, 2008, now Pat. No. 8,210,618.

(60) Provisional application No. 60/935,651, filed on Aug. 23, 2007.

(51) Int. Cl.
*E21C 35/19* (2006.01)

(52) U.S. Cl.
USPC ..... 299/113

(58) Field of Classification Search
USPC ..... 299/113, 111, 112 T, 112 R
See application file for complete search history.

(56) References Cited

U.S. PATENT DOCUMENTS

| | | | | |
|---|---|---|---|---|
| 3,388,757 | A | 3/1967 | Fittinger | |
| 3,336,081 | A * | 8/1967 | Ericsson | 299/113 |
| 3,476,438 | A | 11/1969 | Bower, Jr. | 299/86 |
| 3,599,737 | A | 8/1971 | Fischer | |
| 3,718,370 | A * | 2/1973 | Caserta | 299/113 |

(Continued)

FOREIGN PATENT DOCUMENTS

| | | |
|---|---|---|
| EP | 402655 | 5/1971 |
| EP | 899916 | 5/1980 |

(Continued)

OTHER PUBLICATIONS

Sandvik Coromant Dwg. No. B27/7A, dated Mar. 4, 1982, filed with European Patent Office Nov. 10, 1995.

(Continued)

*Primary Examiner* — John Kreck
(74) *Attorney, Agent, or Firm* — Morgan, Lewis & Bockius LLP

(57) ABSTRACT

A cutting bit includes a tool pick having a head and a shank, and a cutting tip having a body, a cap extending frontwardly from the body, and a base extending rearwardly from the body. The base defines an outer diameter of the cutting tip and a substantially flat rear surface at the rear of the cutting tip. A post extends axially frontwardly from a front surface of the head of the tool pick. A cavity extends axially frontwardly into the base from the rear surface of the cutting tip, the cavity having a diameter equal to or less than about 40% of the outer diameter of the cutting tip. When the cutting tip is mounted to the tool pick, the post is received into the cavity and a portion of the front surface of the tool pick mates with a portion of the rear surface of the cutting tip.

38 Claims, 6 Drawing Sheets

(56) References Cited

U.S. PATENT DOCUMENTS

| | | | | | |
|---|---|---|---|---|---|
| 4,150,728 | A | | 4/1979 | Garner et al. | |
| 4,176,725 | A | | 12/1979 | Shields | |
| 4,302,055 | A | | 11/1981 | Persson | |
| 4,547,020 | A | | 10/1985 | Ojanen | |
| 4,627,665 | A | * | 12/1986 | Ewing et al. | 299/113 |
| 4,702,525 | A | | 10/1987 | Sollami et al. | 299/79 |
| 4,893,875 | A | * | 1/1990 | Lonn et al. | 299/113 |
| 4,911,503 | A | | 3/1990 | Stiffler et al. | |
| 4,940,288 | A | | 7/1990 | Stiffler et al. | |
| 4,941,711 | A | * | 7/1990 | Stiffler | 299/113 |
| 4,981,328 | A | | 1/1991 | Stiffler et al. | |
| 5,141,289 | A | | 8/1992 | Stiffler | |
| 5,219,209 | A | | 6/1993 | Prizzi et al. | |
| 5,823,632 | A | * | 10/1998 | Burkett | 299/104 |
| 6,019,434 | A | * | 2/2000 | Emmerich | 299/111 |
| 6,102,486 | A | * | 8/2000 | Briese | 299/111 |
| 6,270,165 | B1 | | 8/2001 | Peay | |
| 6,428,111 | B1 | | 8/2002 | Kammerer | |
| 6,702,393 | B2 | | 3/2004 | Mercier | |
| 7,172,256 | B2 | | 2/2007 | Sleep et al. | |
| 7,204,560 | B2 | | 4/2007 | Mercier et al. | |
| 2009/0051212 | A1 | * | 2/2009 | Monyak et al. | 299/111 |
| 2010/0109418 | A1 | | 5/2010 | Greenspan et al. | |
| 2010/0109419 | A1 | | 5/2010 | Greenspan et al. | |

FOREIGN PATENT DOCUMENTS

| | | |
|---|---|---|
| EP | 0 395 608 | 10/1990 |
| EP | 0 425 552 | 5/1991 |
| EP | 0 651 133 | 5/1995 |
| GB | 1089611 | 11/1967 |
| SE | 10083 SE | 1/1984 |
| SU | 781341 | 1/1979 |
| WO | WO 96/13968 | 5/1996 |

OTHER PUBLICATIONS

Sandvik Coromant Dwg. No. Sk 11534A, dated Aug. 17, 1982, filed with European Patent Office Nov. 10, 1995.

Office Action for Australian Patent Application No. 2008207495, dated Nov. 26, 2013.

* cited by examiner

REDUCED VOLUME CUTTING TIP AND CUTTING BIT INCORPORATING SAME

CROSS-REFERENCE TO RELATED APPLICATIONS

This application is a continuation-in-part of U.S. patent application Ser. No. 12/192,195, filed Aug. 15, 2008, now U.S. Pat. No. 8,210,618 which claims the benefit of U.S. Provisional Application No. 60/935,651, filed Aug. 23, 2007.

FIELD

The present disclosure relates to a cutting tip for a cutting bit, for example a cutting bit used in mining and construction operations. More particularly, the disclosure relates to a cutting tip formed from a hard material, such as cemented carbide, which includes a base having a cavity accessible from a rear surface of the cutting tip. A post extends from a front surface of a tool pick head and inserts into the cavity of the cutting tip, and the rear surface of the cutting tip mates with the front surface with the tool pick head, to form a strong assembly that is easy to manufacture and assemble.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

A cemented carbide cutting tip for soft cutting conditions generally has a flat rearward facing bonding surface for joining the cutting tip to the head of a tool pick to form a cutting bit. In tougher conditions, a cutting tip that utilizes a recessed or "valve seat" bonding surface is preferred because it can generally withstand higher shear stresses than a cutting tip having a "flat-bottom" bonding surface without becoming dislodged from the tool pick head. Regardless, whether of the flat bottom design or the valve seat design, conventional tips for cutting bits suffer from using an excess of cemented carbide material and from difficulties during assembly.

Additionally, cutting tips of the valve seat design require more material than those of the flat bottom design, since the valve seat is formed by a solid projection of the material of the cutting tip that is countersunk into the body of the tool pick. Thus, while the valve seat design increases the bonding strength of the cutting tip to the tool pick head, it significantly increases the volume of hard material required. The carbide in the valve seat does not contribute to the cutting performance of the cutting bit because the valve seat is used for bonding and the cutting bit loses effectiveness well before the valve seat is exposed by wear processes.

In contrast, a flat bottom cutting tip avoids the need for excess material to form a valve seat. However, because the flat bottom provides less resistance to shear stresses encountered during cutting, a flat bottom cutting tip may be more prone to detachment from the tool pick head during severe cutting conditions. Additionally, alignment during assembly and bonding can be an issue with conventional flat bottom tip designs because flat bottom tips are difficult to keep centered. When cutting tips are "misaligned," operators may be required to correct their orientation, which can be hazardous particularly during hot brazing processes.

SUMMARY

The disclosed cutting tip not only reduces the volume of hard material used but also increases the shear strength of the bonded joint between the cutting tip and the tool pick head, and may also increase the bonding surface area. The disclosed cutting tip has a cavity extending axially into the cutting tip from a bottom surface of the cutting tip. A post extending axially frontward from the tool pick head is inserted into the cavity in the cutting tip.

An exemplary cutting bit is disclosed including a tool pick having a head and a shank, and a cutting tip having a body, a cap extending frontwardly from the body, and a base extending rearwardly from the body. The base of the cutting tip defines an outer diameter of the cutting tip and a substantially flat rear surface at a rear of the cutting tip. A post extends axially frontwardly by a first distance from a front surface of the head of the tool pick. A cavity extends axially frontwardly by a second distance into the base from the rear surface of the cutting tip, the second distance being equal to or greater than the first distance. The cavity has a diameter equal to or less than about 40% of the outer diameter of the cutting tip. When the cutting tip is mounted to the tool pick, the post is received into the cavity and a portion of the front surface of the tool pick mates with a portion of the rear surface of the cutting tip.

An exemplary cutting tip is disclosed for use with a cutting bit including a tool pick having a post extending axially frontwardly from a front surface of a head of the tool pick. The cutting tip includes a body, a cap extending frontwardly from the body, and a base extending rearwardly from the body, the base defining an outer diameter of the cutting tip and a substantially flat rear surface at the rear of the cutting tip. A cavity extends axially frontwardly into the base from the rear surface and has a diameter equal to or less than about 40% of the outer diameter of the cutting tip. When the cutting tip is mounted to the tool pick, the post is received into the cavity and a portion of the front surface of the tool pick mates with a portion of the rear surface of the cutting tip.

An exemplary tool pick is disclosed for use with a cutting bit including a cutting tip having a cavity extending axially frontwardly from a rear surface of the cutting tip, the cutting tip having an outer diameter at the rear surface thereof. The tool pick includes a shank, a head mounted at a frontward end of the shank, the head having a front surface, and a post extending axially frontwardly from the front surface of the head. The post has a diameter equal to or less than about 40% of the outer diameter of the cutting tip. When the cutting tip is mounted to the tool pick, the post is received into the cavity and a portion of the front surface of the tool pick mates with a portion of the rear surface of the cutting tip.

An exemplary mining machine is disclosed. The mining machine includes a rotatable member and one or more cutting bits mounted on the rotatable member. The cutting bit includes a tool pick including a head and a shank, and a post extending axially frontwardly from a front surface of the head of the tool pick. The cutting bit further includes a cutting tip including a body, a cap extending frontwardly from the body, and a base extending rearwardly from the body, the base defining an outer diameter of the cutting tip and a substantially flat rear surface at the rear of the cutting tip. A cavity extends axially frontwardly into the base from the rear surface of the cutting tip, the cavity having a diameter equal to or less than about 40% of the outer diameter of the cutting tip. When the cutting tip is mounted to the tool pick, the post is received into the cavity and a portion of the front surface of the tool pick mates with a portion of the rear surface of the cutting tip.

An exemplary method of manufacturing of a cutting bit includes forming a cutting tip from a hard material, the cutting tip including a body, a cap extending frontwardly from the body, a base extending rearwardly from the body, and defining an outer diameter of the cutting tip and a substantially flat rear surface at the rear of the cutting tip, and a cavity extending axially frontwardly into the base from the rear surface and having a diameter equal to or less than about 40% of the outer diameter of the cutting tip. The method further includes forming a post on a front surface of a head of the tool pick, mounting the cutting tip to the tool pick head such that the post is received into the cavity, and attaching the cutting tip to the front surface of the tool pick head by a joining process.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
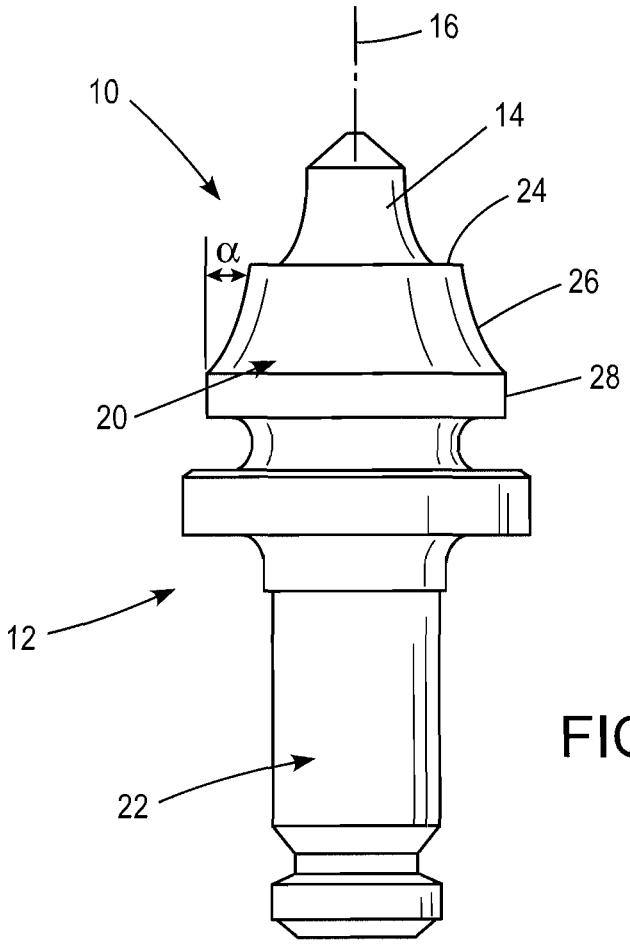
FIG. 1 is an elevation view showing an exemplary embodiment of a cutting bit having a cutting tip mounted to a tool pick.

An exemplary embodiment of a cutting bit 10 is illustrated in FIG. 1. The cutting bit 10 includes a tool pick 12 and a cutting tip 14. The tool pick 12 has a head 20 and a shank 22. The head 20 includes a front surface 24, a side surface 26 extending axially rearwardly from the front surface 24 toward a shoulder 28. The side surface 26 can be of various forms from being oriented substantially perpendicular to a central axis 16 of the cutting bit 10 to being oriented at an angle $\alpha$ to the central axis 16 and combinations thereof. The form of the side surface 26 can be planar, concave, convex, or combinations thereof. The side surface 26 shown in FIG. 1 is an example of a concave form.

A cutting tip 14 is attached to the head 20 of the tool pick 12. The cutting tip 14 is made from a hard material. A suitable hard material for the cutting tip 14 is cemented carbide. An exemplary composition of the cemented carbide includes 6-12 weight percent cobalt with the balance tungsten.

Figure 2:
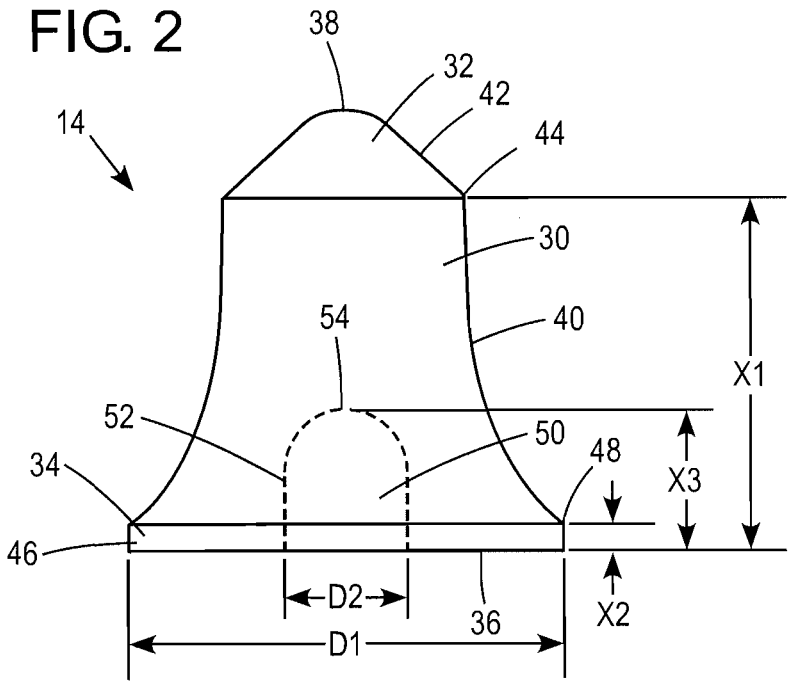
FIG. 2 is an elevation view showing an exemplary embodiment of a cutting tip having a substantially flat rear surface and a cavity extending into the cutting tip from the rear surface.
Figure 3:
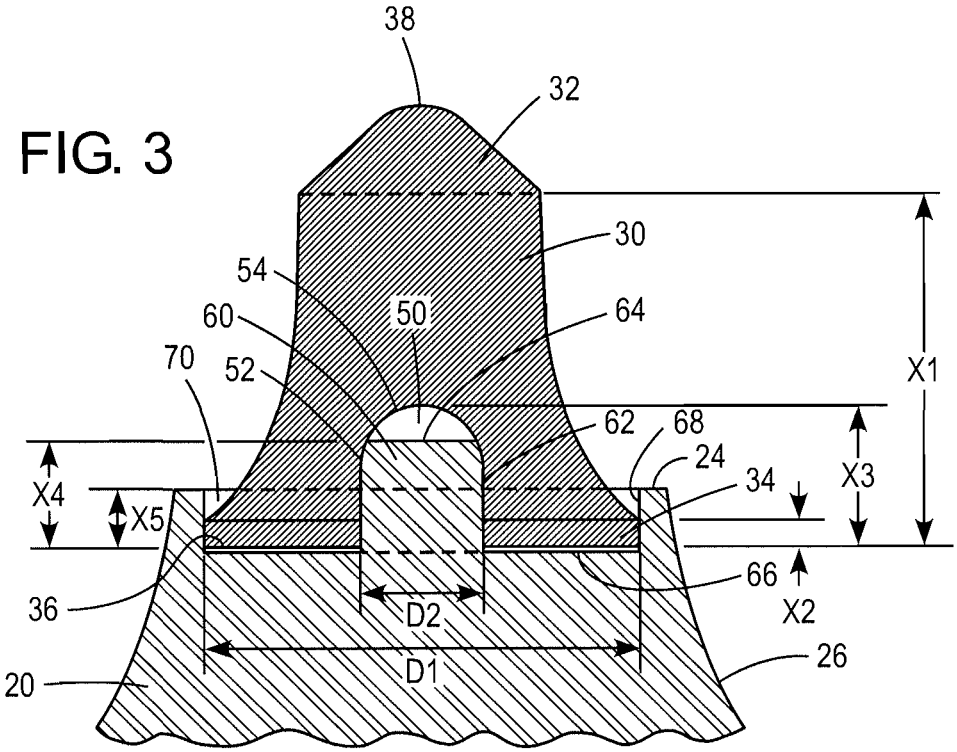
FIG. 3 is a cross-sectional view showing the exemplary embodiment of a cutting tip of FIG. 2 attached to an exemplary embodiment of a tool pick head having a recessed front surface.

An exemplary of a cutting tip 14 is illustrated in FIG. 2, and the cutting tip 14 mounted on an exemplary embodiment of a tool pick head 20 is illustrated in FIG. 3. The cutting tip 14 has a body 30, a cap 32 extending frontwardly from the body 30, and a base 34 extending rearwardly from the body 30. The body 30 has a concave surface 40 over at least a portion thereof. The cap 32 terminates at an end 38 distal from the body 30 and has a surface 42 that extends frontwardly and radially inwardly from the body 30 to the end 38. The surface 40 of the body 30 and the surface 42 of the cap 32 meet at a first junction 44.

The base 34 has a generally cylindrical side surface 46 that defines an outer diameter D1 of the cutting tip 14 and a substantially flat rear surface 36 that is also the rear surface of the cutting tip 14. The side surface 46 of the base portion 34 and the surface 40 of the body 30 meet at a second junction 48. An axial distance from the rear surface 36 to the first junction 44 is defined as X1 and an axial distance from the rear surface 36 to the second junction 48 is defined as X2.

The cutting tip 14 includes a blind cavity 50 extending frontwardly from the rear surface 36 into an interior of the cutting tip 14. The cavity 50 is defined by a cavity wall 52 and a terminates at a cavity end 54. The transition between the cavity end 54 and the cavity wall 52 is smooth and seamless to avoid the introduction of any stress concentrations or stress risers when a load is applied to the cutting tip 14. In the disclosed embodiment, the cavity end 54 is hemispherical and the cavity wall 52 is tangent to the cavity end 54 so that there is a continuous slope from the cavity wall 52 into the curvature of the cavity end 54. The cavity 50 is located radially inward from the circumference of the rear surface 36. The cavity 50 has a nominal diameter D2 measured at the junction of the cavity wall 52 and the rear surface 36 of the cutting tip 14. In an exemplary embodiment, the cavity 50 is centered with respect to the diameter D1 of the cutting tip 14. Inclusion of the cavity 50 reduces the amount of hard material used in forming the cutting tip 14, as compared to conventional designs, particularly compared to solid cutting tips without a cavity. Therefore, it is desirable for the cavity 50 to have as large a diameter D2 as possible without impairing the ability of the cutting tip 14 to withstand the stresses imposed during use.

It has been found that the diameter D2 should be limited to a maximum of approximately 40% of the outer diameter D1 of the cutting tip 14. A ratio of the cavity diameter D2 to the outer cutting tip diameter D1 of greater than 40% may cause portions of the body 30 to be too thin, resulting in fracture under stress. It has also been found that a diameter D2 of less than about 20% of the outer diameter D1 of the cutting tip 14 results in negligible material savings and shear strength improvement. Therefore, the ratio of the cavity diameter D2 to the outer cutting tip diameter D1 should range from about 20% to about 40%, alternatively from about 28% to about 35%.

The cavity end 54 is located at a distance X3 from the rear surface 36. In one embodiment, as shown in FIGS. 2 and 3, the distance X3 is greater than the distance X2 but is less than the distance X1 so that the cavity 50 extends through the base 34 and into the body 30. In another embodiment, as shown in FIGS. 4 and 5, the distance X3 is less than or equal to the distance X2, or is slightly greater than the distance X2, so that the cavity 50 is fully contained or nearly fully contained within the base 34.

The cavity 50 can be of any shape. In one embodiment, the cavity wall 52 is substantially cylindrical in shape. In another embodiment, the cavity wall 52 is inwardly tapered at an angle with respect to the axis 16 so that the cavity 50 is widest at the rear surface 36 and narrowest at the cavity end 54. Tapering the cavity wall 52 facilitates removal of the cutting tip 14 from a mandrel that is used to form the cavity 50 when the cutting tip 14 is molded or formed under pressure. The angle of taper can be between about 4 degrees and about 25 degrees. More typically, the angle of taper can be between about 10 degrees and about 20 degrees. In one embodiment, the angle of taper is preferably about 16 degrees.

Figure 4:
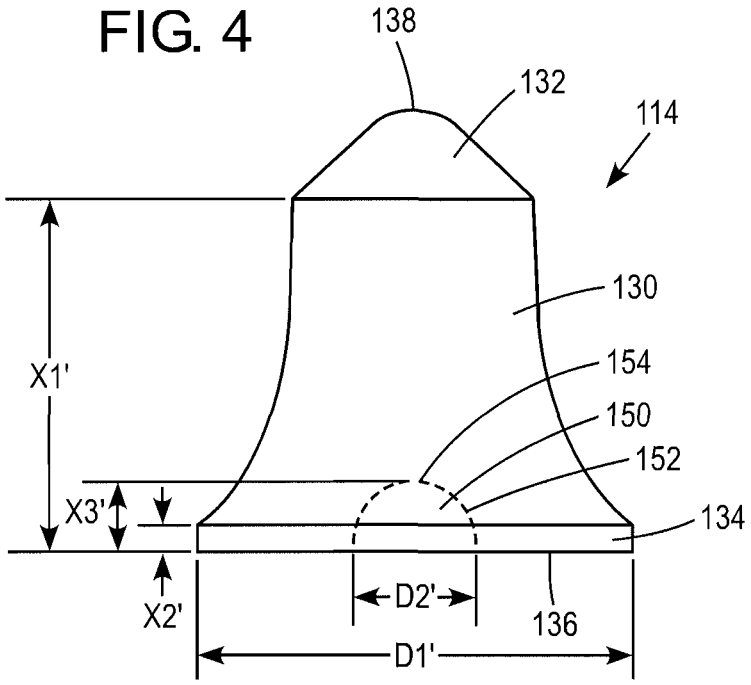
FIG. 4 is an elevation view of another exemplary embodiment of a cutting tip having a substantially flat rear surface and a cavity extending into the cutting tip from the rear surface.
Figure 5:
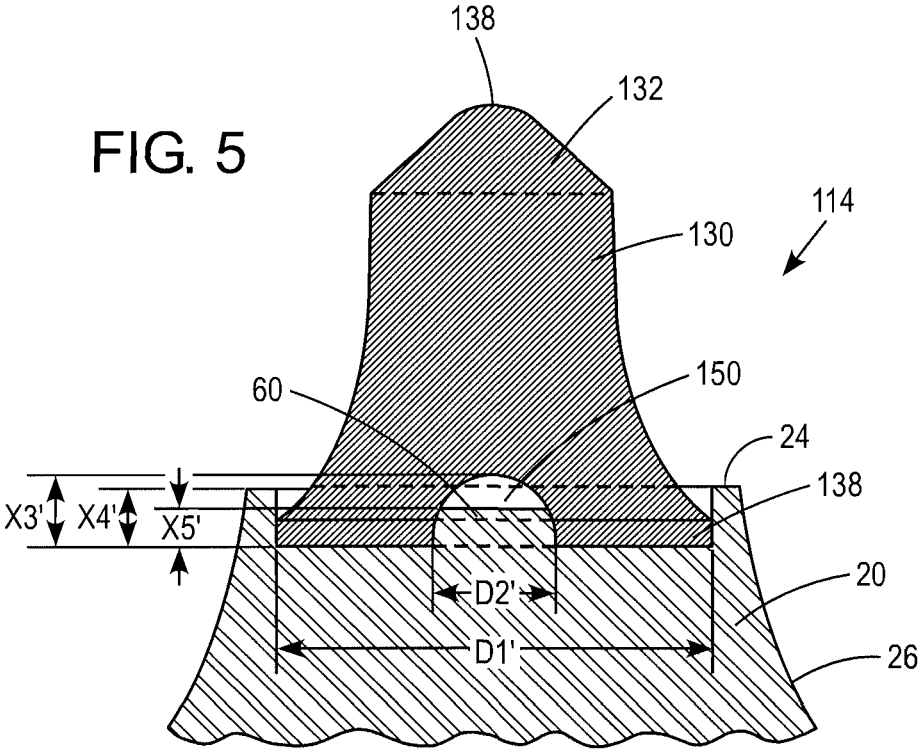
FIG. 5 is a cross-sectional view showing the exemplary embodiment of a cutting tip of FIG. 4 attached to an exemplary embodiment of a tool pick head having a recessed front surface.

An alternate of a cutting tip 114 is shown in FIG. 4. The cutting tip 114 includes a blind cavity 150 extending frontwardly from a rear surface 136 into an interior of the cutting tip 114. The cavity 150 is defined by a cavity wall 152 and terminates at a cavity The transition between the cavity end 154 and the cavity wall 152 is smooth and seamless to avoid the introduction of any stress concentrations or stress risers when a load is applied to the cutting tip 114. In the disclosed embodiment, the cavity end 54 is hemispherical and the cavity wall 152 is tangent to the cavity end 154 so that there is a continuous slope from the cavity wall 52 into the curvature of the cavity end 154. 154. The cavity 114 is located radially inward from the circumference of the rear surface 136. The cavity 114 has a nominal diameter D2' measured at the junction of the cavity wall 152 and the rear surface 136 of the cutting tip 114. In an exemplary embodiment, the cavity 150 is centered with respect to the diameter D1' of the cutting tip 114.

As in the of FIG. 2, it has been found that the diameter D2' should be limited to a maximum of approximately 40% of the outer diameter D1' of the cutting tip 114 to retain sufficient strength in the cutting tip 114, but that the diameter D2' should be at least about 20% of the outer diameter D1' of the cutting tip 114 to provide adequate material savings and shear strength improvement. Therefore, the ratio of the cavity diameter D2' to the outer cutting tip diameter D1' should range from about 20% to about 40%, alternatively from about 28% to about 35%.

As shown in FIG. 3, an exemplary of a tool pick head 20 for mating with the cutting tip 14 includes a post 60 extending frontwardly from the head 20 by a distance X4. The post 60 can be formed on the head 20 by various mechanical or thermomechanical processes, including by cold heading, forging, or machining. When the cutting tip 14 is mounted to the head 20, the post 60 is received into the cavity 50 of the cutting tip 14. The distance X4 is less than or equal to the distance X3, so that the post 60 can extend partway or all the way into the cavity 50. The post 60 is defined by a post sidewall 62 and a post end 64. The shape and taper of the post sidewall 62 closely match the shape and taper of the cavity wall 52. A small clearance may be provided between the post sidewall 62 and the cavity wall 52 to enable the cutting tip 14 to be easily installed onto and removed from the body 20, or to allow for the flow of brazing material or other joining material. Alternatively, the post sidewall 62 and cavity wall 52 may engage in a snug fit so that the cutting tip 14 has to be pressed onto the body 60. In an embodiment in which the distance X4 is approximately equal to the distance X3, the shape of the post end 64 closely matches the shape of the cavity end 54.

It has been found that the shear strength of the joint between the cutting tip 14 and the head 20 can be significantly improved even with a relatively short post 60, regardless whether the post 60 extends partially or full to the end 54 of the cavity. In one embodiment, the length X4 of the post 60 is equal to or less than about 25% of the outer diameter D1 of the cutting tip 14. In another embodiment, the length X4 of the post 60 is equal to or less than about 10% of the outer diameter of the cutting tip 14.

In the depicted embodiment of FIG. 3, the body 20 includes a recess 70 bounded by a recessed surface 66 and a dam wall 68. The recessed surface 66 is substantially parallel to and located rearwardly from the front surface 24 by a distance X5. When the post 60 is fully inserted into the cavity 50, the rear surface 36 of the cutting tip 14 mates with the recessed surface 66 of the head 20. In the depicted embodiment, the distance X4 is greater than the distance X5, so that the post 60 extends frontwardly out of the recess 70 beyond the front surface 24. In another embodiment, the distance X4 is approximately equal to the distance X5 so that the post 60 is approximately flush with the front surface 24. In yet another embodiment, as shown in FIG. 5, the distance X4 is less than the distance X5 so that the post 60 terminates within the recess 70.

The cutting tip 14 is attached to the head 20 of the tool pick 12 by a joining process including, but not limited to, one or more of welding, brazing, soldering, and adhesive bonding. The welding, brazing, soldering, or adhesive bonding occurs along at least a portion of the mating interface between the rear surface 36 of the cutting tip 14 and the recessed surface 66 of the head 20 to fix the cutting tip 14 to the head 20. The joining process may also occur between the post sidewall 62 and the cavity wall 52. The dam wall 68 helps to prevent brazing material or other joining material from flowing out from between the cutting tip 14 and the head 20, and also acts as a stress reliever as the head 20 cools after brazing. In a exemplary embodiment, the distance X5 is greater than or approximately equal to the distance X2 so that the base 34 is completely recessed within the dam wall 66. In other embodiments, the distance X5 is less than the distance X2, so that the base 34 partially extends above the front surface 24.

The post 60 significantly increases the shear loading that can be carried between the cutting tip 14 and the head 20 during use of the cutting bit 10. Without being bound by theory, it is believed that during shear loading of the cutting tip 14, the post 60 engages the cavity 50 to prevent lateral movement of the cutting tip 14 with respect to the head 20, and also to inhibit torsional movement of the cutting tip 14 about a lateral axis with respect to the head 20 that could cause a portion of the rear surface 36 of the cutting tip 14 to dislodge from the recessed surface 66. In addition, the engagement between the post 60 and the cavity 50 helps align and center the cutting tip 14 on the head 20 when the cutting tip 14 is being mounted.

Figure 6:
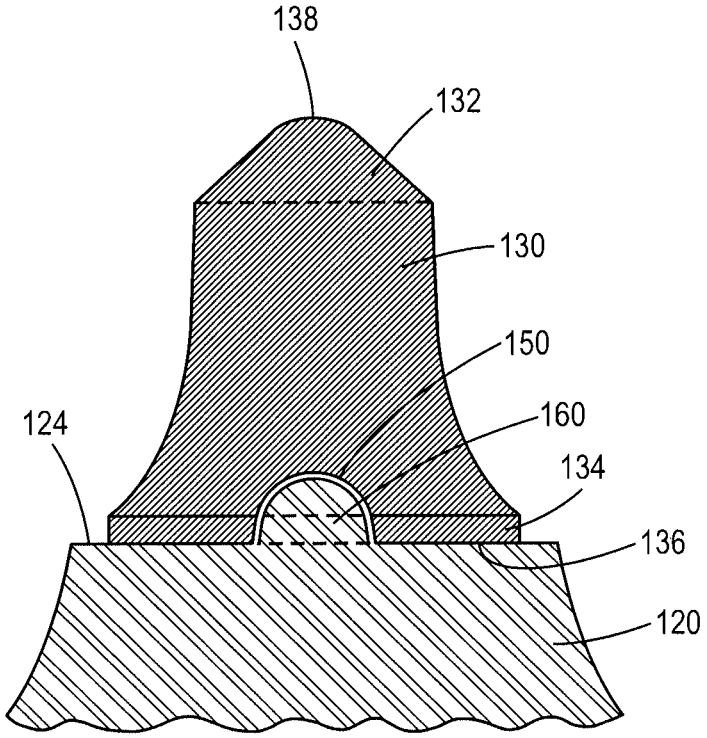
FIG. 6 is a cross-sectional view showing the exemplary embodiment of a cutting tip of FIG. 4 attached to another exemplary embodiment of a tool pick head having a substantially flat front surface.

In the depicted of FIG. 6, a tool pick head 120 has a substantially flat front surface 124 that does not include a recess. Conventional cutting tips are typically difficult to center on such flat-faced tool pick heads which do not have a post as disclosed herein. The front surface 124 does not include a recess, as compared with the embodiments shown in FIGS. 3 and 5. Therefore, when the cutting tip 114 is mounted to the head 120, the cutting tip 114 does not recess into the head 120 from the front surface 124, but instead the rear surface 136 of the cutting tip 114 sits flush on the front surface 124 of the head 120. The head 120 includes a post 160 extending frontwardly from the front surface 124 of the head 120 by a distance X4'. As depicted, the length X4' of the post 160 is approximately equal to the depth X3' of the cavity 150 in the cutting tip 114. In alternate embodiments, the length X4' of the post 160 may be shorter than the depth X3' of the cavity 150 so that the post 160 does not extend all the way into the cavity 150.

The cutting tip 114 is attached to the head 120 of the tool pick 112 by a joining process including, but not limited to, one or more of welding, brazing, soldering, and adhesive bonding. The welding, brazing, soldering, or adhesive bonding occurs along at least a portion of the mating interface between the rear surface 136 of the cutting tip 114 and the front surface 124 of the head 120 to fix the cutting tip 114 to the head 120. The joining process may also occur between the post sidewall 162 and the cavity wall 152.

The post 160 significantly increases the shear loading that can be carried between the cutting tip 114 and the head 120 during use of the cutting bit 110. Without being bound by theory, it is believed that during shear loading of the cutting tip 114, the post 160 engages the cavity 150 to prevent lateral movement of the cutting tip 114 with respect to the head 120, and also to inhibit torsional movement of the cutting tip 114 about a lateral axis with respect to the head 120 that could cause a portion of the rear surface 136 of the cutting tip 114 to dislodge from the front surface 124. In addition, the engagement between the post 160 and the cavity 150 helps align and center the cutting tip 114 on the head 120 when the cutting tip 114 is being mounted, which is particularly important in the flat-faced head 120 which lacks a recess to aid in centering.

Figure 7A:
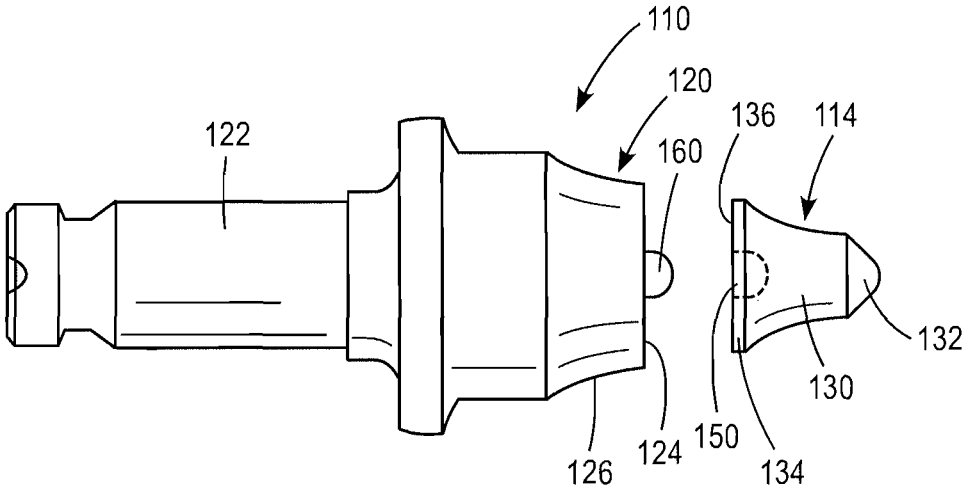
FIG. 7A is an exploded schematic elevation view showing an exemplary embodiment of a cutting bit having a cutting tip and a tool pick.
Figure 7B:
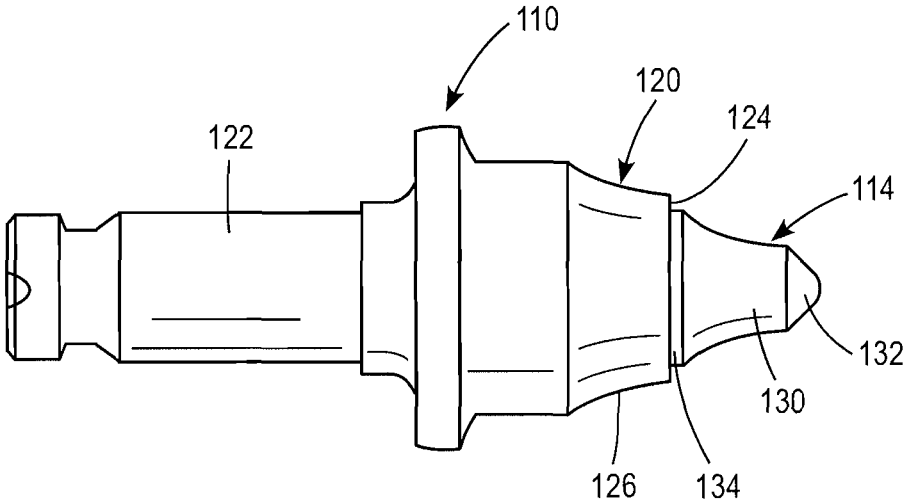
FIG. 7B is an assembled schematic elevation view of the exemplary embodiment of a cutting bit of FIG. 7A.
Figure 7C:
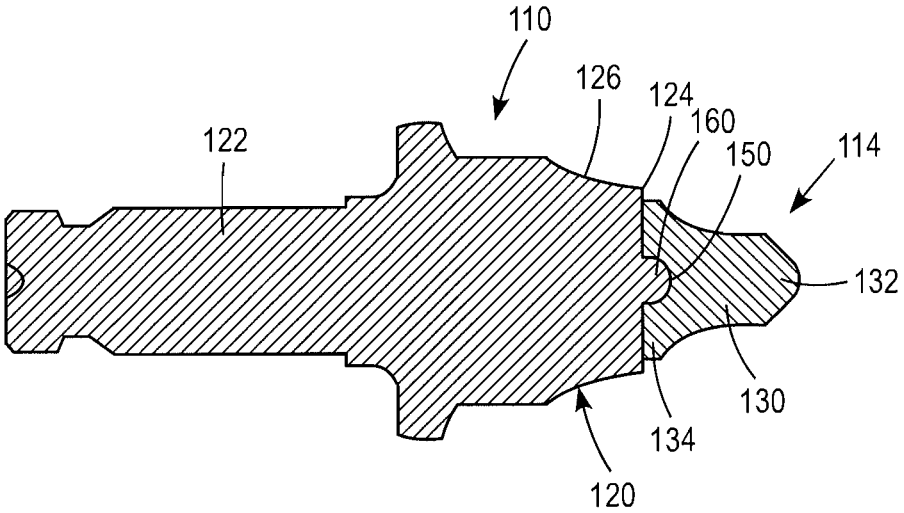
FIG. 7C is cross-sectional schematic view of the exemplary of a cutting bit of FIG. 7B.

FIGS. 7A-7C depict a cutting bit 110 having a cutting tip 114 and a tool pick 112 with a head 120 corresponding to that shown in FIG. 6. FIG. 7A shows positioning the cutting tip 114 prior to installation on the head 120, FIG. 7B shows the cutting tip 114 assembled onto the head 120, and FIG. 7C shows a cross-sectional view of the cutting tip 114 assembled onto the head 120 with the post 160 being received into the cavity 150 for centering and aiding in securing the cutting tip 114 to the head 120.

Together, the post 160 inserted in the cavity 150 forms a mechanical connection that enables the cutting tip 114 to withstand greater externally-applied shear loads without becoming detached as compared with an arrangement lacking a cavity 150 and mating post 160. Also, when the rear surface 136 of the cutting tip 114 is joined, for example by brazing, to the front surface 124 of the head 120, the joining material may be enabled to also flow between the post 160 and the cavity 150 to increase the effective surface area over which the joining process occurs. Therefore, a stronger bond results from the joining process than that for a conventional surface mounting without posts and cavities.

Further, the arrangement of mating cavities and posts increases wear life of the cutting tip for at least the reason that the post extends axially past at least a portion of the base and thus past the point of maximum diameter of the cutting tip, which tends to counteract forces generated during operation of the cutting bit, particularly lateral forces acting on the cutting tip. In addition, the mating cavity and post arrangement provides a self-centering feature which facilitates the bonding process by holding the cutting tip and the cutting bit in the desired relative positions.

It should be understood that one can incorporate different combinations of the features, such as posts and cavities, from the described exemplary embodiments. For example, the distal end of the post can be, variously, above, even to or below the plane of the front surface with a commensurate arrangement of the cavity in the cutting tip to accommodate such a post. Similarly, the arrangement of the front face, the dam wall and any recess for the cutting tip in any one embodiment can incorporate various combinations of these disclosed features.

Testing was conducted to determine the shear loading required to dislodge a cutting tip from both a conventional design lacking a post and the embodiment disclosed herein with reference to FIGS. 6 and 7A-7C in which a post 160 extends frontwardly from the front surface 124 of the head 120 and is received in the cavity 150 of the cutting tip 114. A load was applied at an angle of about 45 degrees with respect to the braze surface, i.e., the interface between the front surface 124 of the head 120 and the rear surface 136 of the cutting tip 114. For the conventional design lacking a post, the cutting tip consistently became dislodged at load of between about 8,000 PSI and about 10,000 PSI. In contrast, in the disclosed having a post, the cutting tip was unable to be dislodged at a load as high as 12,000 PSI, the maximum pressure available on the equipment used to conduct the testing. Therefore, at a minimum, the improvement disclosed herein yields and improvement in shear loading applied to the tip of between about 17% and about 50%. Further testing is being conducted to determine a range of shear loading failures for the disclosed embodiment, which will likely show the improvement to be even greater.

Cutting bits 10, 110 with reduced volume cutting tips 14, 114, respectively, can be incorporated into a mining machine, construction machine, tunneling machining or trenching machine, such as Sandvik model MT720 tunneling machine or Voest-Alpine's Alpine Bolter Miner ABM 25. An exemplary mining machine comprises a rotatable drum and one or more cutting bits 10, 110 mounted on the rotatable drum. A similar construction on a rotatable member occurs in applications for road construction, tunneling and trenching.

Cutting bits 10, 110 having the disclosed features can be manufactured by any suitable means. In one exemplary method, the cutting bit is manufactured by forming a cutting tip from a hard material, forming a post on a front surface of a head of the tool pick, mounting the cutting tip on the head so that the post is received into the cavity, and attaching the cutting tip to the front surface by a joining process. The tool pick can be formed by, for example, compacting and sintering hard materials, such as cemented carbide. The post can be formed by, for example, cold heading, forging, machining or material shaping method. The joining process can include one or more of welding, brazing, soldering and adhesive bonding. Forming the tool pick head can optionally include forming a recess in the front surface of the head, such that when the cutting tip is mounted to the head, the cutting tip is partially recessed into the head.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cutting bit, comprising:

a tool pick including a head and a shank;

a post extending axially frontwardly by a first distance from a front surface of the head of the tool pick, the post having a diameter;

a cutting tip including a body, a cap extending frontwardly from the body, and a base extending rearwardly from the body, the base defining an outer diameter of the cutting tip and a substantially flat rear surface at the rear of the cutting tip; and a cavity extending axially frontwardly by a second distance into the base from the rear surface of the cutting tip, the second distance being equal to or greater than the first distance, the cavity having a diameter equal to or less than about 40% of the outer diameter of the cutting tip;

wherein when the cutting tip is mounted to the tool pick, the post is received into the cavity and a portion of the front surface of the tool pick mates with a portion of the rear surface of the cutting tip.

2. The cutting bit of claim 1, wherein the diameter of the cavity is equal to or greater than about 20% of the outer diameter of the cutting tip.

3. The cutting bit of claim 1, wherein the first distance is equal to or less than about 25% of the outer diameter of the cutting tip.

4. The cutting bit of claim 1, wherein the cavity has a generally cylindrical shape having a slight taper so that the diameter of the cavity gradually decreases as the cavity extends from the rear surface into cutting tip.

5. The cutting bit of claim 4, wherein the taper of the cavity is about 16 degrees.

6. The cutting bit of claim 4, wherein the post has a shape and taper to match the shape and taper of the cavity.

7. The cutting bit of claim 4, wherein the cavity further includes a hemispherical end.

8. The cutting bit of claim 1, wherein the post is formed onto the tool pick by cold heading.

9. The cutting bit of claim 1, wherein the post is formed by onto the tool pick by machining.

10. The cutting bit of claim 1, wherein the cutting tip is attached to the tool pick by a joining process.

11. The cutting bit of claim 10, wherein the joining process is selected from the group consisting of welding, brazing, soldering and adhesive bonding.

12. The cutting bit of claim 11, wherein the diameter of the post is slightly less than the diameter of the cavity such that joining material can flow in a gap between a wall of the cavity and the post.

13. The cutting bit of claim 1, the head of the tool pick including a recess in the front surface for receiving at least a portion of the base of the cutting tip, the recess having a recessed surface located at a third distance rearward from the front surface for contacting the rear surface of the cutting tip; wherein the post extends frontwardly from the recessed surface.

14. The cutting bit of claim 13, wherein the first distance is less than the third distance.

15. The cutting bit of claim 13, wherein the first distance is approximately equal to the third distance.

16. The cutting bit of claim 13, wherein the first distance is greater than the third distance.

17. The cutting bit of claim 1, wherein the cutting tip has a composition including a cemented carbide.

18. A cutting tip for use with a cuffing bit including a tool pick having a post extending axially frontwardly from a front surface of a head of the tool pick, the cutting tip comprising:

a body;

a cap extending frontwardly from the body;

a base extending rearwardly from the body, the base defining an outer diameter of the cutting tip and a substantially flat rear surface at the rear of the cutting tip; and a cavity extending axially frontwardly into the base from the rear surface and having a diameter equal to or less than about 40% of the outer diameter of the cutting tip;

wherein when the cutting tip is mounted to the tool pick, the post is received into the cavity and a portion of the front surface of the tool pick mates with a portion of the rear surface of the cutting tip; and wherein the cavity has a generally cylindrical shape having a slight taper so that the diameter of the cavity gradually decreases as the cavity extends from the rear surface into the cutting tip.

19. The cutting tip of claim 18, wherein the diameter of the cavity is equal to or greater than about 20% of the outer diameter of the cutting tip.

20. The cutting tip of claim 18, wherein the taper of the cavity is about 16 degrees.

21. The cutting tip of claim 18, wherein the cutting tip has a composition including a cemented carbide.

22. A tool pick for use with a cutting bit including a cutting tip having a cavity extending axially frontwardly from a rear surface of the cutting tip, the cutting tip having an outer diameter at the rear surface thereof, the tool pick comprising:

a shank;

a head mounted at a frontward end of the shank, the head having a front surface; and a post extending axially frontwardly from the front surface of the head, the post having a diameter equal to or less than about 40% of the outer diameter of the cutting tip;

wherein when the cutting tip is mounted to the tool pick, the post is received into the cavity and a portion of the front surface of the tool pick mates with a portion of the rear surface of the cutting tip.

23. The tool pick of claim 21, wherein the diameter of the post is equal to or greater than about 20% of the outer diameter of the cutting tip.

24. The tool pick of claim 21, wherein the post has a length equal to or less than about 25% of the outer diameter of the cutting tip.

25. The tool pick of claim 21, wherein the post is formed by machining.

26. The tool pick of claim 21, wherein the head of the tool pick includes a recess in the front surface for receiving at least a portion of a base of the cutting tip, the recess having a recessed surface located at a distance rearward from the front surface for contacting the rear surface of the cutting tip; and wherein the post extends frontwardly from the recessed surface.

27. The tool pick of claim 26, wherein the recess and the post are formed by machining.

28. A mining machine, comprising:

a rotatable member; and one or more cutting bits mounted on the rotatable member;

wherein the cutting bit includes:

a tool pick including a head and a shank;

a post extending axially frontwardly from a front surface of the head of the tool pick;

a cutting tip including a body, a cap extending frontwardly from the body, and a base extending rearwardly from the body, the base defining an outer diameter of the cutting tip and a substantially flat rear surface at the rear of the cutting tip; and a cavity extending axially frontwardly into the base from the rear surface of the cutting tip, the cavity having a diameter equal to or less than about 40% of the outer diameter of the cutting tip;

wherein when the cutting tip is mounted to the tool pick, the post is received into the cavity and a portion of the front surface of the tool pick mates with a portion of the rear surface of the cutting tip.

29. The mining machine of claim 28, wherein the diameter of the cavity is equal to or greater than about 20% of the outer diameter of the cutting tip.

30. The mining machine of claim 28, wherein the post has a length equal to or less than about 25% of the outer diameter of the cutting tip.

31. The mining machine of claim 28, wherein the cutting tip is joined to the tool pick head by brazing.

32. The mining machine of claim 28, wherein the front surface of the tool pick head is a substantially flat surface.

33. The mining machine of claim 28, wherein the front surface of the tool pick head includes a recess having a recessed surface from which the post extends.

34. A method of manufacturing of a cutting bit, the method comprising:

forming a cutting tip from a hard material, the cutting tip including:

a body;

a cap extending frontwardly from the body;

a base extending rearwardly from the body, the base defining an outer diameter of the cutting tip and a substantially flat rear surface at the rear of the cutting tip; and a cavity extending axially frontwardly into the base from the rear surface and having a diameter equal to or less than about 40% of the outer diameter of the cutting tip; forming a post on a front surface of a head of the tool pick, wherein the post has a length equal to or less than about 25% of the outer diameter of the cutting tip;

mounting the cutting tip to the tool pick head such that the post is received into the cavity; and attaching the cutting tip to the front surface of the tool pick head by a joining process.

35. The method of claim 34, wherein the diameter of the cavity is equal to or greater than about 20% of the outer diameter of the cutting tip.

36. The method of claim 34, further comprising forming a recess in the front surface of the head of the tool pick;

wherein mounting the cutting tip to the tool pick includes inserting a portion of the base of the cutting tip into the recess.

37. The method of claim 34, wherein the post and the cavity self-centers the cutting tip on the tool pick head.

38. The method of claim 34, wherein forming the post on a front surface of the tool pick head includes machining.

* * * * *

UNITED STATES PATENT AND TRADEMARK OFFICE

CERTIFICATE OF CORRECTION

PATENT NO. : 8,678,517 B2
APPLICATION NO. : 12/908193
DATED : March 25, 2014
INVENTOR(S) : Kenneth Monyak, Daniel Mouthaan and Joseph Fader It is certified that error appears in the above-identified patent and that said Letters Patent is hereby corrected as shown below:

In the Specification

Column 3, line 15: Delete "DRAWING" and insert --DRAWINGS--.

Column 3, line 48: After "FIG. 7C is" insert --a-- and after "exemplary" insert --embodiment--.

Column 4, line 3: After "exemplary" insert --embodiment--.

Column 5, line 11: After "alternate" insert --embodiment--.

Column 5, line 22: Delete "the cavity end 154. 154. The cavity 114" and insert --the cavity end 154. The cavity 150--.

Column 5, line 24: Delete "cavity 114" and insert --cavity 150--.

Column 5, line 29: After "As in the" insert --embodiment--.

Column 5, line 39: After "exemplary" insert --embodiment--.

Column 5, line 64: Delete "full" and insert --fully--.

Column 6, line 33: Delete "wall 66" and insert --wall 68--.

Column 6, line 49: After "depicted" insert --embodiment--.

Column 8, line 10: After "disclosed" insert --embodiment--.

Signed and Sealed this
Ninth Day of September, 2014

Michelle K. Lee

Michelle K. Lee
*Deputy Director of the United States Patent and Trademark Office*

In the Claims

Claim 13, column 9, line 32: After “claim 1,” insert --wherein--.

Claim 23, column 10, line 22: Delete “claim 21” and insert --claim 22--.

Claim 24, column 10, line 25: Delete “claim 21” and insert --claim 22--.

Claim 25, column 10, line 28: Delete “claim 21” and insert --claim 22--.

Claim 26, column 10, line 30: Delete “claim 21” and insert --claim 22--.